US005884564A

United States Patent [19]

Fountas

[11] Patent Number: 5,884,564

[45] Date of Patent: Mar. 23, 1999

[54] ANTI-BACKUP DEVICE FOR POWER-AND-FREE CONVEYOR SYSTEMS

[75] Inventor: Thomas A. Fountas, Racine, Wis.

[73] Assignee: Custom Conveyor & Supply Corp., Racine, Wis.

[21] Appl. No.: 838,149

[22] Filed: Apr. 15, 1997

[51] Int. Cl.[6] ..... B61B 10/00

[52] U.S. Cl. ..... 104/250; 104/172.4; 104/251; 188/82.1

[58] Field of Search ..... 104/172.3, 172.4, 104/249, 250, 251, 252, 257; 188/61, 62, 63, 82.1, 82.8

[56] References Cited

U.S. PATENT DOCUMENTS

| | | | |
|---|---|---|---|
| 3,149,715 | 9/1964 | Massiniani | 104/249 |
| 3,354,834 | 11/1967 | Orwin | 104/172.4 |
| 3,503,471 | 3/1970 | Balke | 104/249 |
| 3,565,012 | 2/1971 | Nearman | 104/172.4 |
| 3,759,189 | 9/1973 | Desilets | 104/172.4 |
| 5,060,789 | 10/1991 | Nelson | 104/249 |

*Primary Examiner*—Mark T. Le
*Attorney, Agent, or Firm*—Ronald P. Brockman

[57] ABSTRACT

In a power-and-free conveyor system an anti-backup devise for attachment at a work station comprising a block, and a stop and a cam mounted on the block and a spring for applying force to the cam to frictionally engage a wheel of a trolley on the power-and-tree system.

3 Claims, 3 Drawing Sheets

ANTI-BACKUP DEVICE FOR POWER-AND-FREE CONVEYOR SYSTEMS

BACKGROUND OF THE INVENTION

The invention relates to power-and-free conveyor systems of the type shown in U.S. Pat. No. 3,759,189, issued Sep. 18, 1973. The invention is particularly applicable to work carriers having front and rear trolleys constructed so as to permit close-packing or accumulation, and which pass through transfer points.

Among the problems with power-and-free systems is the danger of a carrier's inadvertently backing up. This can be overcome by the use of anti-backup means mounted on the carrier frame, such as disclosed in U.S. Pat. No. 's 3,159,189 and 3,354,834. However, those systems have slippage and, because they have cams which ride along the tracks, substantial wear of the anti-backup device occurs.

BRIEF SUMMARY OF THE INVENTION

According to the invention, a cam is pivotally mounted on a block which is attached to a trolley track at a work station of a power-and-free system, The cam has a convexedly curved cam face to the front of the cam face, rear and front referring to the designed direction of advancement of the carrier, A spring, which is attached to the cam and block, holds the cam in its resting position and applies force to a wheel of a carrier during operation. Upon contact by the wheel of a carrier with a cam face, the cam face is moved forwardly against the resistance of the spring. When the wheel passes the rearmost portion of the convexedly curved cam face, the spring pulls the cam rearwardly. The cam prevents the trolley from backing up upon contact with the cam face. Concurrently, the wheel applies force on the cam face, preventing the spring from returning the cam to its resting position.

The result is a anti-backup device which prevents a work carrier from backing up, regardless of the speed of inertia induced in the carriers. The device also allows for the accumulation of carriers.

In this specification the expression "front"and "rear"and "forward"and "rearward"refer to the designed direction of

DETAILED DESCRIPTION OF THE PREFERRED EMBODIMENT

The invention is especially adopted for use with power-and-free conveyor systems of the type shown in U.S. Pat. No. 3,415,201. In such systems a plurality of trolley-type carriers indicated at 11 in FIG. 1 from which workpieces (not shown) are suspended and which are movable along an overheard trolley track indicated at 12. A power driven chain (not shown) is located adjacent to the work carriers and is provided with spaced pusher members (not shown) which are selectively engageable with and disengageable from the work carriers in a predetermined manner to effect the desired workpiece delivery in the direction of the arrow 13 of the figures.

Figure 1:
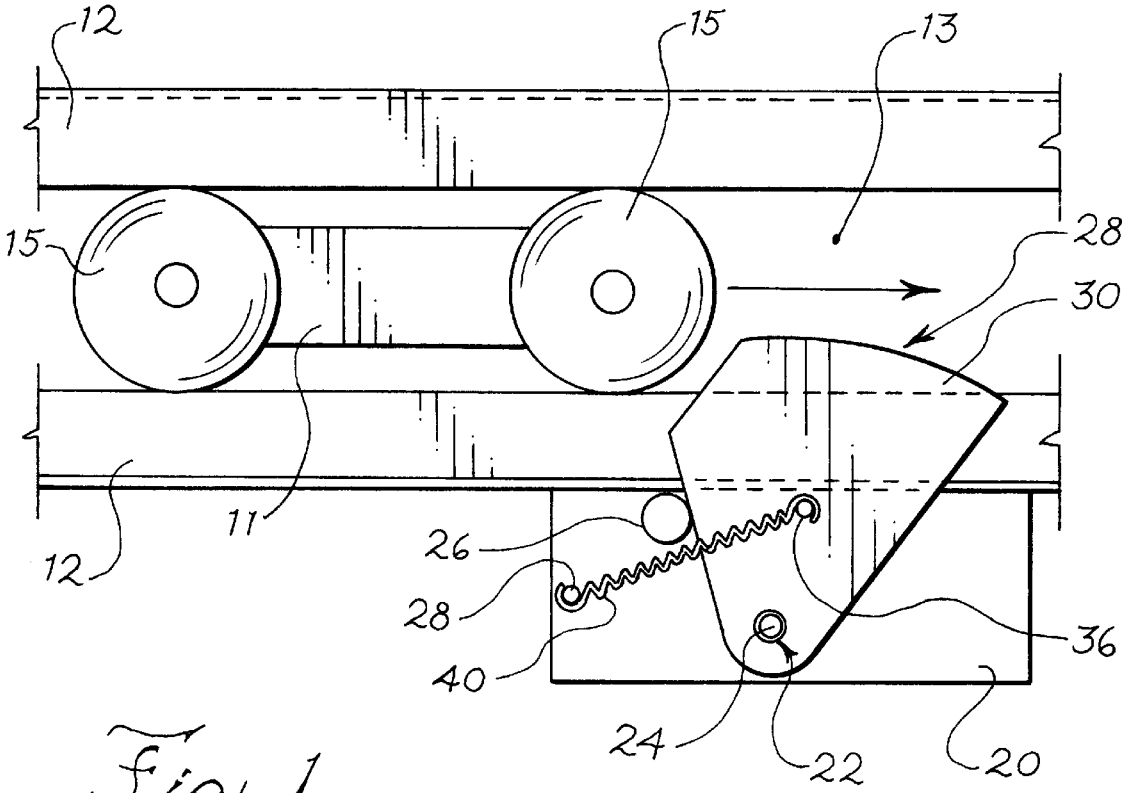
FIG. 1 is a diagrammatic view of a portion of a power-and-free system showing the device of this invention attached in place on a trolley track.

Referring to FIG. 1, the device is made up of a block 20, a bushing 22, a cam member 30, and spring 40. The block 20, preferably made up of steel, is generally elongated and rectangular in shape. The block 20 has a laterally extending shaft 24 capable of receiving the bushing 22. In the preferred embodiment the bushing 22 is an oil lube bushing which is known in the art. The block 20 has a stopping member 26 which extends laterally and a means for attachment to a trolley rail.

The cam member 30 of the invention, which is preferably made of wear resistant steel, is pivotally attached to the block 20 by an aperture 32 through which the shaft 24 passes and has a convexedly curved cam face 38. The bushing 22 is placed between the cam member 30 and the shaft 24 through the aperture 32. The stopping member 26 limits the rearward movement of the cam member 30 in its resting position. The spring 40, which is preferably a high carbon steel extension spring known in the art, is attached at its ends to the cam 30 by a pin 36 and the block 20 by a pin 28. The force of the spring 40 pulls the cam rearwardly toward the stopping member 26. The block 20 has a means for stationary attachment to the track portion of a power-and-free system, which in the preferred embodiment is by welding.

Figure 2:
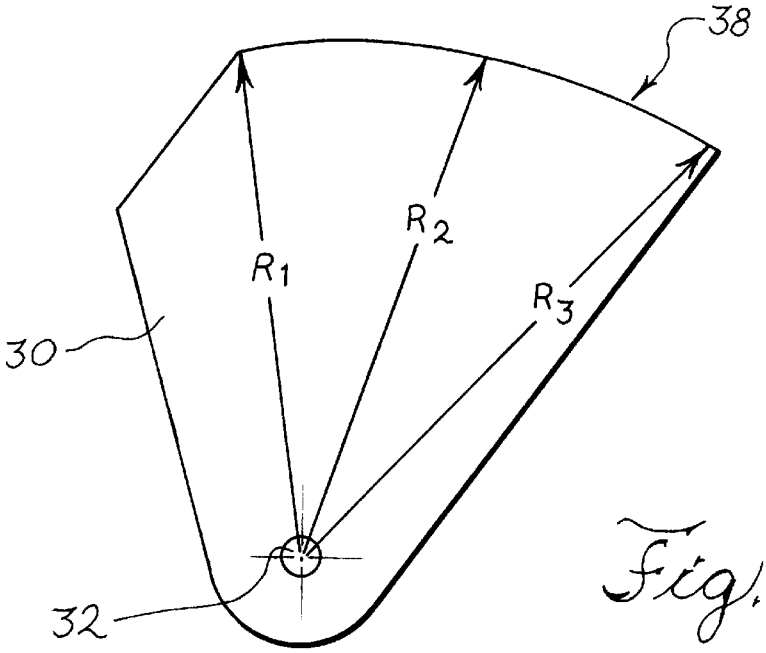
FIG. 2 is a diagrammatic lateral view showing the configuration of the convex cam face.
Figure 3A:
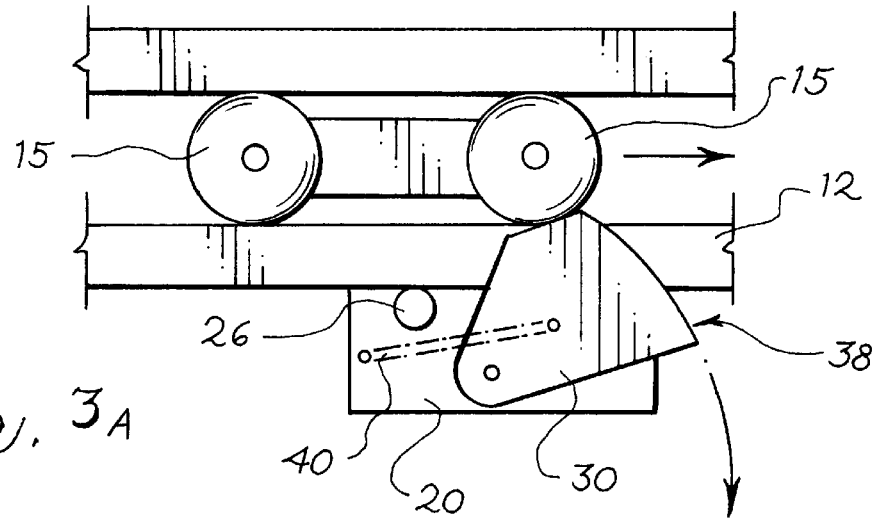
FIG. 3 is a series of diagrammatic views showing the relationship between the cam face of the anti-backup device and wheel of a carrier during the operation of this invention.
Figure 3B:
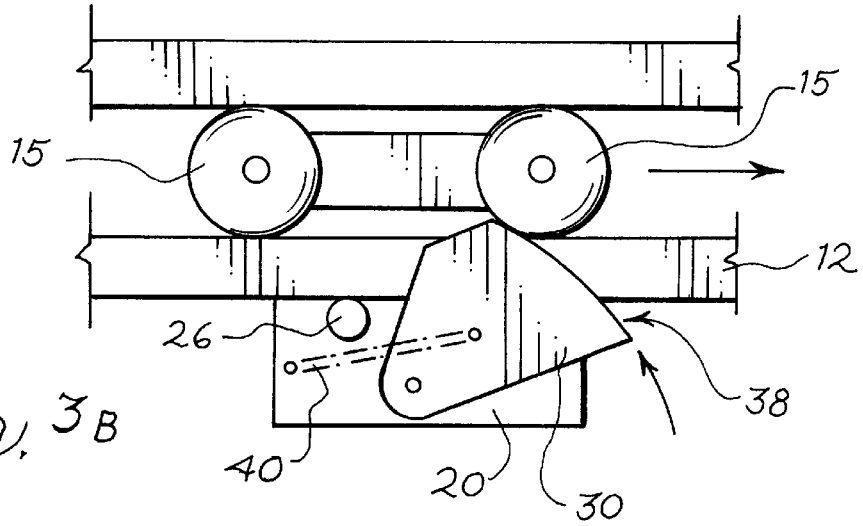
Figure 3C:
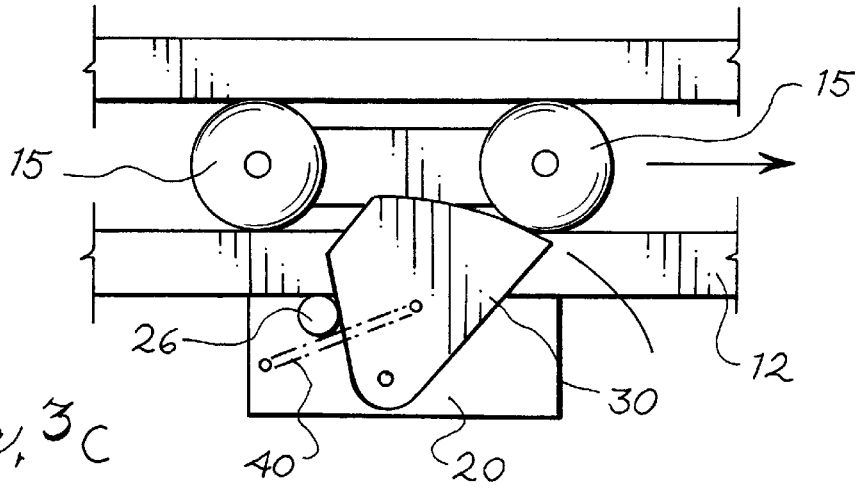

Referring to FIG. 2, the convexedly curved cam face 38 of the cam member 30 has progressively increasing radial distances $R_1$–$R_3$ from the axis of pivoting (center of aperture 32) of the cam member 30, such that $R_1<R_2–R_3$. While in the preferred embodiment the radial distance increases in length 0.345% per degree of rotation, the device will function with lesser and greater increases in the radius per degree of rotation. Referring to FIG. 3*a*–3*c*, during operation of the power-and-free system, the cam member 30, upon contact by a carrier wheel 15, is pushed forward thereby causing the cam to move away from the path of the wheel 15, The force of the spring 40 holds the cam 30 against the carrier wheel 15.

In operation when the forward moving carrier wheel 15 passes the rearward portion of the convexedly curved cam face 38, the cam 30 is pulled rearwardly, its movement being limited by the wheel 15 with which it is in contact. (FIG. 3*a* through 3*c*). The cam 30, in return, prevents the rearward movement of the carrier by working in conjunction with the track member 12 opposite the cam 30 to lock the carrier wheel 15 to prevent back-up.

In the preferred embodiment, the stopping member is positioned such that the axis formed by the shortest distance from the cam face to the axis of pivoting of the cam member is at right angles to the trolley track.

Figure 4:
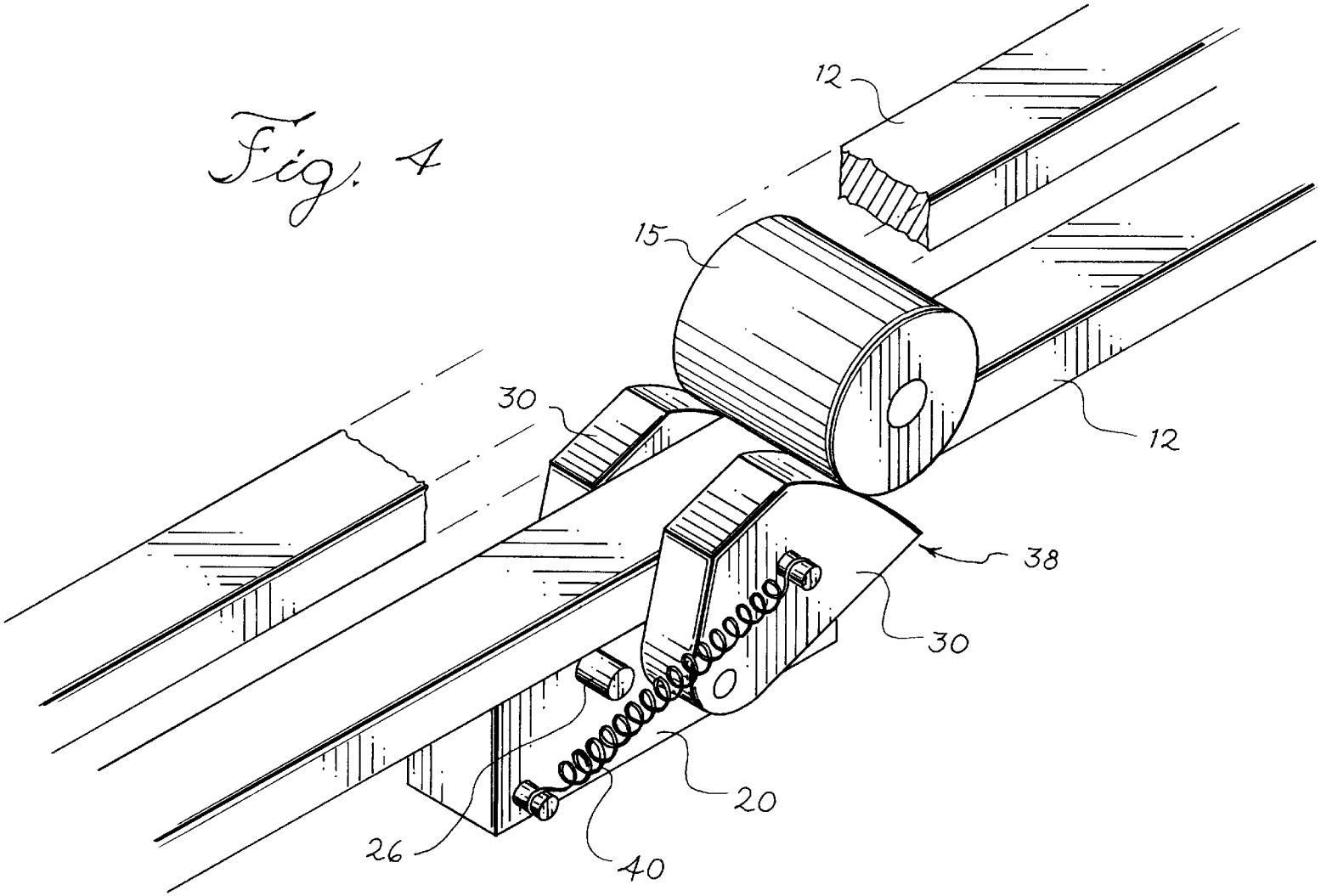
FIG. 4 is a schematic perspective view of a portion of the power-and-free carrier system showing a device of this invention with double cams.

In the preferred embodiment the block is attached to the trolley track of a power-and-free system by welding. Alternatively, the block may be bolted to the trolley track. In other embodiments the block may be attached to the frame of the power-and-free system. In another embodiment as shown in FIG. 4 , a pair of cam 30 and springs 40 may be mounted on opposite sides of the block 20, with the trolley track 12 lying between the cams 30 when they are in place.

I claim:

1. An anti-backup device for use in a power-and-free conveyor system powered by a driver chain and having a plurality of work carriers which are selectively engageable and disengageable from the driver chain and which are carried along rails, the anti-backup device comprising:

a) a six-sided block having adjacent first and second sides, the first side having means to attach to a rail of a power-and-free conveyor system with the rail having a horizontal carrying surface, and the second side being parallel to the long axis of the rail and vertical to the carrying surface of the rail when the block is attached to the rail, and the second side having a stopping member and a shaft;

b) an oil lube bushing mounted on the shaft of the block;

c) a cam member rockably mounted on the block by the shaft and oil lube bushing's placement into an aperture in the cam member, the cam member being of sufficient length to extend beyond the carrying surface of the rail when it is in its resting position and having:

a cam face with a convexedly curved configuration and frictional surface; the cam face having a progressively increasing distance from the center of the aperture of the cam member with the rearmost part of the cam face having the least distance from the center, the convexedly curved cam face being situated forward of a vertical plane which runs through center of the aperture considering the trolley track of the power-and-free system as horizontal when the cam is in its resting position;

d) an extension spring having two ends, one of which is removably attached to the cam and the other removably attached to the block, such that the spring pulls the cam face rearwardly, but which allows a wheel of a carrier upon contact to push the cam face forwardly until the wheel of a carrier comes in contact with the cam face and which pulls the cam rearwardly against the stopping member in the operating position.

e) means to attach one end of the spring to the cam and the other end to the block.

2. The anti-backup device of claim 1, wherein a second set of cam, springs and stopping member are mounted on the side opposite to second side of the block.

3. The anti-backup device of claim 1 wherein the radial distance from the axis of pivoting to cam face surface increases 0.2% to 0.4% for each 1° of rotation of the cam.

* * * * *